343-700 MS AU 251 EX
3/8/88 OR 4,730,193

United States Patent [19]
Schwartz et al.

[11] Patent Number: 4,730,193
[45] Date of Patent: Mar. 8, 1988

[54] MICROSTRIP ANTENNA BULK LOAD

[75] Inventors: Leonard Schwartz, Montville; James B. Mead, Brookside, both of N.J.; Emile J. Deveau, Pleasantville, N.Y.

[73] Assignee: The Singer Company, Montvale, N.J.

[21] Appl. No.: 836,897

[22] Filed: Mar. 6, 1986

[51] Int. Cl.[4] ..... H01Q 1/38
[52] U.S. Cl. ..... 343/700 MS; 343/846
[58] Field of Search ..... 343/700 MS, 737, 846, 343/770, 771, 853, 829; 333/22 R

[56] References Cited

U.S. PATENT DOCUMENTS 4,180,817 12/1979 Sanford ..... 343/700

FOREIGN PATENT DOCUMENTS 99803 6/1982 Japan ..... 343/700 MS
1109833 8/1984 U.S.S.R. ..... 333/22 R

OTHER PUBLICATIONS

IBM Technical Disclosure Bulletin, vol. 9, No. 11, Apr. 1967, "Common Resistive Termination for Conductors".

*Primary Examiner*—William L. Sikes
*Assistant Examiner*—Michael C. Wimer
*Attorney, Agent, or Firm*—David L. Davis

[57] ABSTRACT

A continuous strip of bulk absorbing material is bonded to the looped ends of the arrays of a microstrip antenna for reducing the power that normally would have been reflected back across the arrays.

14 Claims, 12 Drawing Figures

MICROSTRIP ANTENNA BULK LOAD

FIELD OF THE INVENTION

The present invention relates to microstrip antennas, and more particularly to a bulk load for reducing the residual power in the arrays of a microstrip antenna.

BRIEF DESCRIPTION OF THE PRIOR ART

Microstrip antennas which utilize two sets of parallel interleaved microstrip planar arrays are taught in copending applications, "Interleaved Microstrip Planar Array," Ser. No. 650,491, now U.S. Pat. No, 4,603,332 and "Crossover Traveling Wave Feed," Ser. No. 650,631, now U.S. Pat. No. 4,605,931 both by the present applicants and assigned to the same assignee. The most relevant known prior art for reducing residual power in the arrays of a microstrip antenna utilizes individual loads bonded to the end of each array. Each of these loads must absorb the residual power in the corresponding array and each of the loads has to be physically bonded to the end of the corresponding array. As a typical microstrip antenna has a plurality of arrays, to individually bond matching loads to the arrays becomes prohibitively expensive and time consuming.

BRIEF DESCRIPTION OF THE PRESENT INVENTION

The present invention is directed to a microstrip structure which includes a continuous strip of absorber material connected to the end of each array. Thus, instead of having individual loads soldered to each array, a load comprising a continuous strip of absorber material for the entire microstrip antenna is used.

Therefore, the present invention presents the significant advantage of using only one low-cost continuous strip for terminating the residual power in all of the arrays, keeping in mind that, were the arrays to be individually terminated, the cost would be unacceptable, given the low cost of the entire microstrip antenna. A second advantage of the present invention resides in the fact that a substantial saving of labor is involved, as each array no longer needs to be individually bonded to a corresponding load.

The above-mentioned objects and advantages of the present invention will be more clearly understood when considered in conjunction with the accompanying drawings, in which:

DETAILED DESCRIPTION OF THE INVENTION

Figure 1:
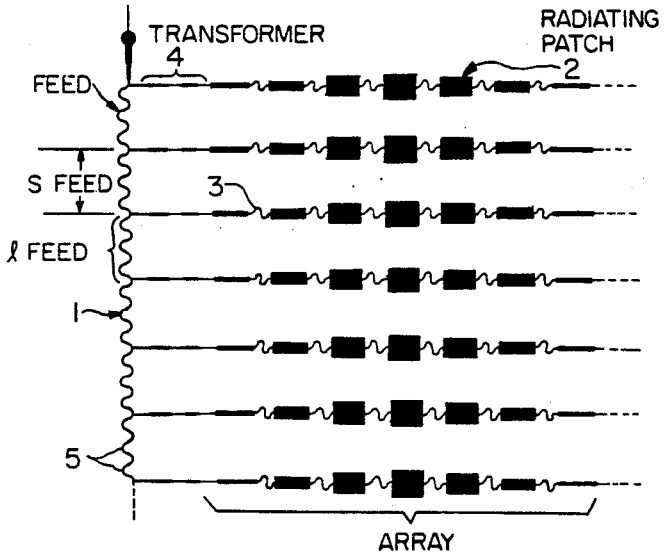
FIG. 1 (PRIOR ART)
FIG. 1 illustrates a section of a prior art antenna structure.

In a conventional microstrip antenna shown in FIG. 1, a single feed, indicated at reference numeral 1, is attached to a plurality of arrays of patch radiators such as shown at 2. The patches are half-wave resonaters which radiate power from the patch edges, as described in the mentioned copending applications. In order to control beam width, beam shape and side lobe level, the amount of power radiated by each patch must be set. The power radiated is proportional to the patch conductance, which is related to wavelength, line impedance and patch width. These patches are connected by phase links such as indicated at 3, which determine the beam angle relative to the axis of the arrays.

The arrays formed by patches and phase links are connected to the feed line through a two-stage transformer 4 which adjusts the amount of power tapped off the feed 1 into the array. The feed is made up of a series of phase links 5 of equal length, which control the beam angle in the plane perpendicular to the arrays. The feed is also a traveling wave structure. The power available at any given point is equal to the total input power minus the power tapped off by all previous arrays. These structures are broadband limited only by the transmission medium and the radiator bandwidth. In this case, the high Q of the patch radiators limits the bandwith to a few percent of the operating frequency.

Our copending invention, "Interleaved Microstrip Planar Array," conceptually operates as two independent antennas of the type discussed in connection with FIG. 1. However, implementation is achieved by interleaving two antennas so as to form superposed apertures in the same plane thereby minimizing the space necessary for the antennas.

Figure 2A:
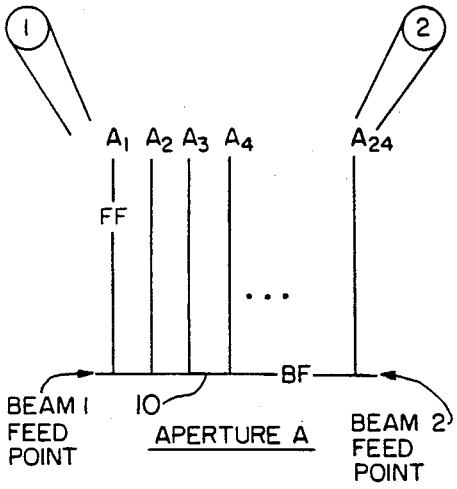
FIG. 2A is a simplified diagrammatic view of a first aperture of an interleaved antenna structure.
Figure 2B:
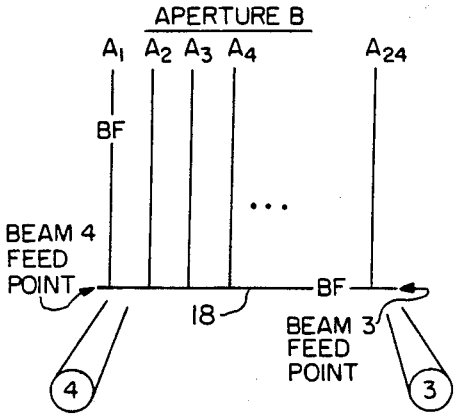
FIG. 2B is a simplified diagrammatic view of a second aperture of an interleaved antenna structure.

The two apertures are diagrammed, in a simplified manner, in FIGS. 2A and 2B, respectively. Aperture A may, for example, consist of 24 forward fire arrays connected to a single backfire feed 10. Aperture B, shown in FIG. 2B, is similarly constructed with a single backfire feed 18. However, aperture B is provided with backfire arrays instead of the forward fire arrays of aperture A. A traveling wave entering a forward/backfire structure produces a beam in a forward/backward direction. The four beams and their associated feed points are shown. When driving the interleaved antenna structure, the various feed points are sequentially driven.

Figure 3:
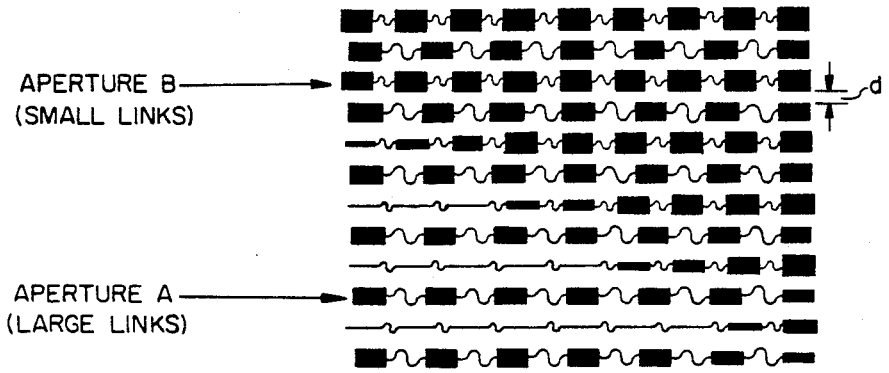
FIG. 3 illustrates a portion of an interleaved antenna structure.

A partial view of our copending interleaved antenna structure is shown in FIG. 3. The arrays wherein the radiating elements are interconnected by large links correspond to aperture A and these will be seen to occupy positions as even-numbered arrays. Conversely, those radiating elements interconnected by small links correspond to aperture B and are seen to occupy the odd-position arrays. Accordingly, the arrays of apertures A and B alternate in an interleaved, regularly alternating order. It is desirable to make the distance "d" between adjacent arrays as large as possible to assure good isolation between the two separate apertures. However, this would limit the patch width, making control of beam shaping difficult. Accordingly, the patch width values selected are a compromise to permit satisfactory performance for gamma image, side lobes and overwater error.

Figure 4:
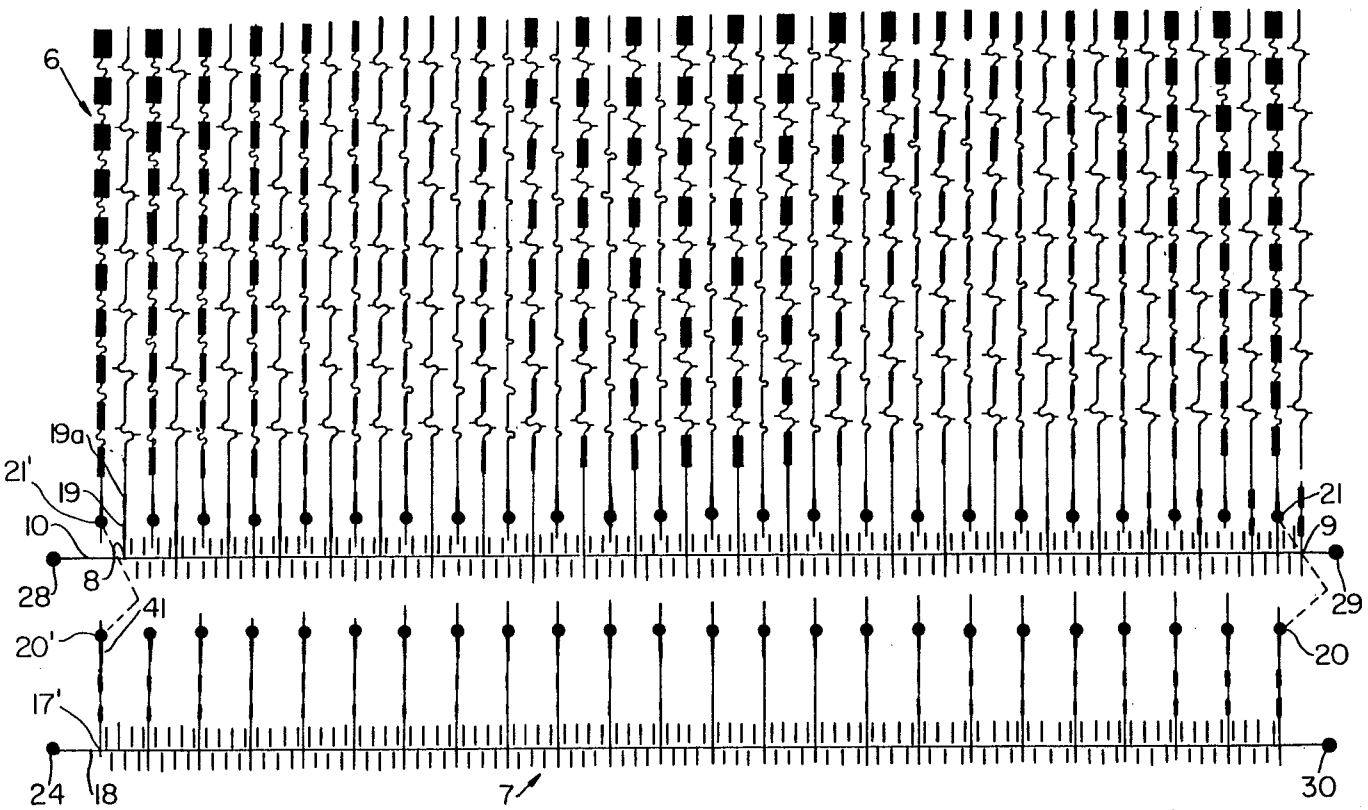
FIG. 4 is an illustration of a "feed thru" connective portion of an interleaved antenna structure.

Referring to FIG. 4, reference numeral 6 generally indicates the printed circuit artwork for etching interleaved antennas of our copending invention. As discussed in connection with FIG. 2, the alternating arrays of apertures A and B exist in coplanar relation. Backfire feed line 10 is connected to each of the even-positioned arrays corresponding to aperture A and backfire feed line 18 is connected to each of the odd-positioned arrays corresponding to aperture B. Thus, for example, junction point 8 exists between backfire feed line 10 and the second illustrated array via two-stage transformers 19 and 19*a*. Feed point 28 corresponds with the first beam as previously mentioned in connection with FIG. 2A while feed point 29 corresponds with the second beam of that figure. The rightmost array also corresponds with aperture A of FIG. 2A and this array is seen to be connected to backfire feed line 10 at junction point 9. The feed point 29 at the right end of backfire feed line 10 corresponds with the feed point for the second beam as described in connection with FIG. 2A. Similarly, feedpoint 24 corresponds with the fourth beam as previously mentioned in connection with FIG. 2B while feedpoint 30 corresponds with the third beam of that figure. Feed thru connections between pads 20, 21 and 20', 21' are indicated by illustrated dotted lines. A detailed view of the feed thru construction and explanation thereof appear in aforenoted copending application Ser. No. 650,491, now U.S. Pat. No. 4,603,332. Also described in our copending application, "Interleaved Microstrip Planar Array, Ser. No. 650,491, the feed for aperture B is insulated, space relation-wise, from the arrays of aperture A in order to access the interleaved arrays of aperture B without interfering with aperture A. To accomplish this end, a feed thru printed circuit strip 7 in the form of etched conductors is developed. In a preferred embodiment of the invention, as was disclosed in the Ser. No. 650,491 application (U.S. Pat. No. 4,603,332), the edged conductor portions of the main antenna structure and those of the feed thru strip 7 are prepared on a single substrate and appropriately separated. By positioning the feed thru strip 7 in insulated overlying relation with the interleaved antenna 6, power may be made to pass through feed 18 to individual backward firing arrays of the interleaved antenna. Thus, for example, as was discussed previously, by driving feed point 24, which corresponds to the fourth beam feed point of FIG. 2B, power is tapped off at junction point 17' to the interconnected conductive section 41, terminating in feed thru pad 20'. And with feed thru strip 7 in appropriate overlying relation with the feed end of interleaved antenna 6, feed thru pad 20' is positioned in registry with feed thru pad 21' of the first backward firing array, thereby completing a connection between feed point 24 and the array. As was previously stated, this feed thru connection between pads 20' and 21' is indicated by the illustrated dotted line. Ditto for the connection between connecting pads 20 and 21.

Figure 5:
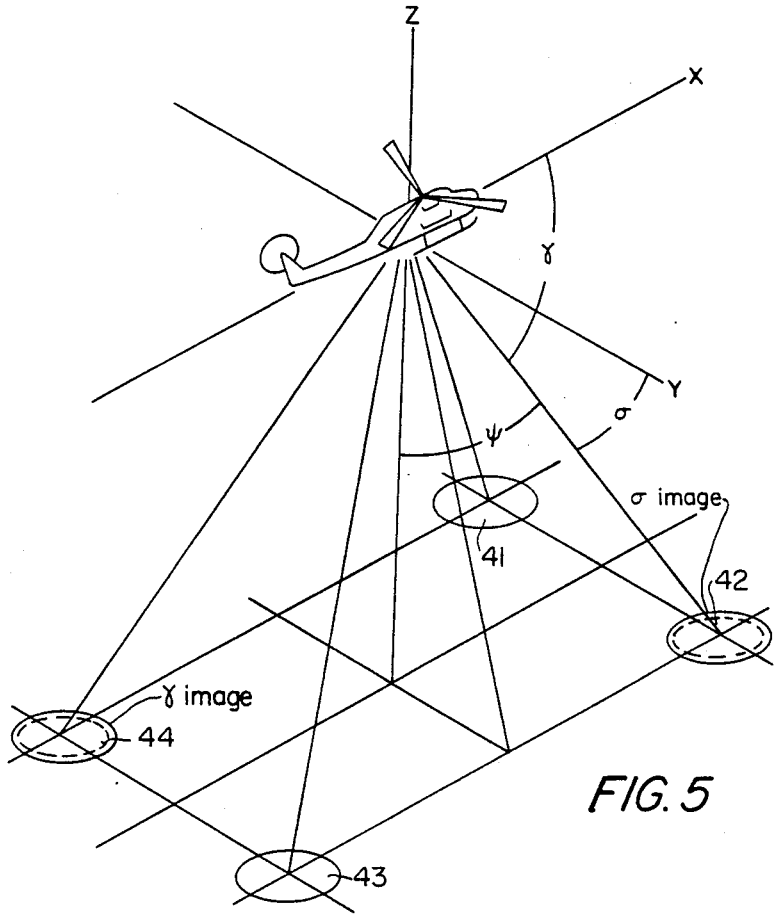
FIG. 5 is a diagrammatic representation of four radiated beams and the effect residual power in the arrays has on one of the beams.

By using the above-mentioned microstrip antenna in an aircraft, for example, the helicopter shown in FIG. 5, four beams for a doppler radar system are emitted. As shown, three angles are associated with each beam—the $\gamma$ angle designating the angle between the beam and the x axis, the $\sigma$ angle designating the angle between the beam and the y axis, and the $\psi$ angle designating the angle between the beam and the z axis. As was mentioned previously, at any one instant in time, only one of the four beams is emitted.

When the helicopter is flying level, the main beam, i.e., the beam which is being transmitted at the time, for example beam 41, is found in the forward left position. From this beam two images are generated—the $\gamma$ image, which is found in the aft left position, and the $\sigma$ image, in the forward right position. Both the main beam and its associated images will be at the same $\psi$ angle. Under certain conditions of pitch and roll, one of these images may point very nearly straight downward, its associated $\psi$ angle being small. The main beam, tipping away from the z axis, will have a large $\psi$ angle. In flight over smooth water or smooth terrain, beams with small $\psi$ angles are enhanced over those with large $\gamma$ angles. This could cause the system to falsely lock onto the image beam leading to navigational errors. Keeping the image levels at least 16.5 dB below the main beam will prevent false lock on in most cases.

Figure 6:
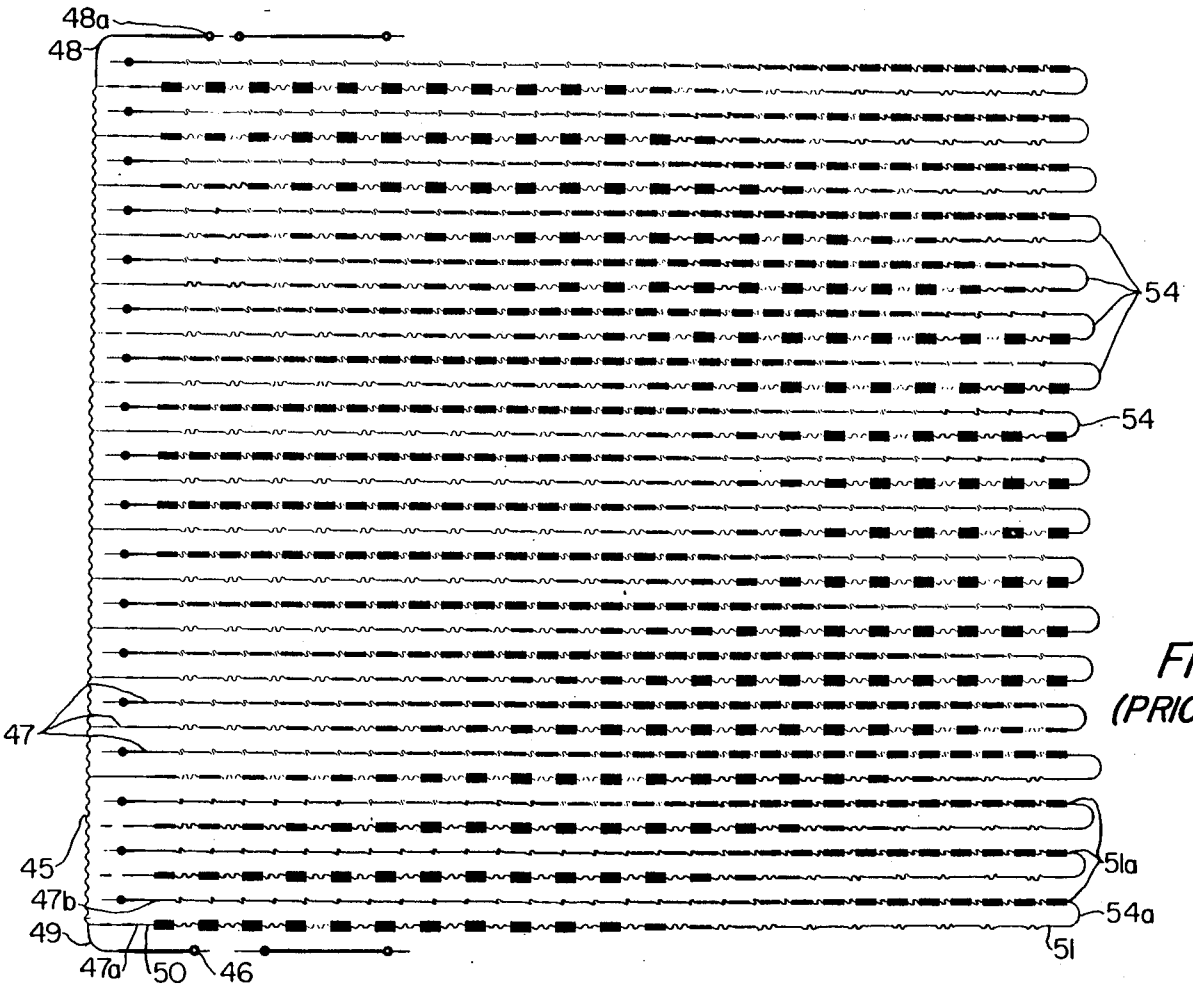
FIG. 6 (PRIOR ART)
FIG. 6 illustrates an entire radiating plane having loop ends.

The $\gamma$ image is caused by the reflection of residual power at the end of each array 51*a* in FIG. 6. To elaborate, as was mentioned previously, the arrays of a microstrip antenna are fed by a feed line, which supplies an amount of power to each array. The amount of power from the beginning of an array is different from the end of the same array, as power is tapped by the half-wave resonaters within the array. For example, the microstrip antenna of FIG. 6 shows power of approximately 0 dB being fed to feed line 45 from feed point 46. The serpentine line 45 distributes this power in a controlled fashion to each of the alternate arrays 47. On serpentine line 45, there is less power at point 48 than at point 49, as power is tapped by successive arrays. Once power gets into an array, it is radiated into space, by the resonators, in order to form the main beam. Concentrating on array 47*a*, there is a power loss of approximately 12 dB between point 50 and point 51. If all of this power were to be reflected, a gamma image approximately 12 dB below the main beam would result.

In FIG. 6, array 47*a* is connected to an alternate array 47*b* by loop 54*a*. This loop termination of the array directs most of the residual power of 51*a* into alternate arrays, i.e. 47*b*. Some reflection occurs, yielding a $\gamma$ image of approximately 15 dB. The power which is directed into the alternate arrays contributes to the $\sigma$ image, which is primarily due to a reflection at 48*a* when power is input at 46. The resultant $\sigma$ image level is approximately 14 dB.

Figures 7A, 7B:
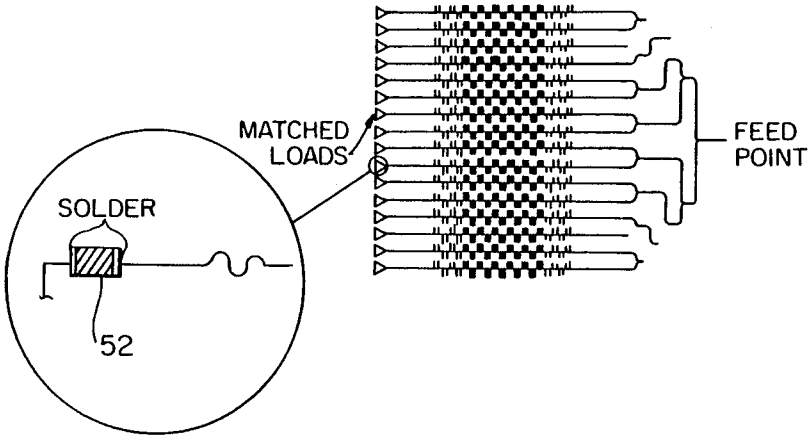
FIG. 7A illustrates a method of loading each array individually.
FIG. 7B is an enlarged view of one particular matched lead of FIG. 7A.

One method of reducing the $\gamma$ and $\sigma$ image power to acceptable levels is by adding individual loads to each of the arrays. For the example microstrip antenna shown in FIG. 4, where each array is open ended, corresponding individual loads, such as resistor 52 shown in FIG. 7, can be bonded to the end of each of the arrays, thereby preventing power from reflecting back through the array. But, since there is a plurality of arrays in a microstrip antenna, a corresponding number of matched loads would be needed. Further, the labor involved in bonding each array with a matched load would be prohibitively expensive, when viewed in terms of the low cost of the entire microstrip antenna. Thus, such a corrective measure would be costly and complex, when given the low cost and simplicity required of a microstrip antenna.

Figure 8A:
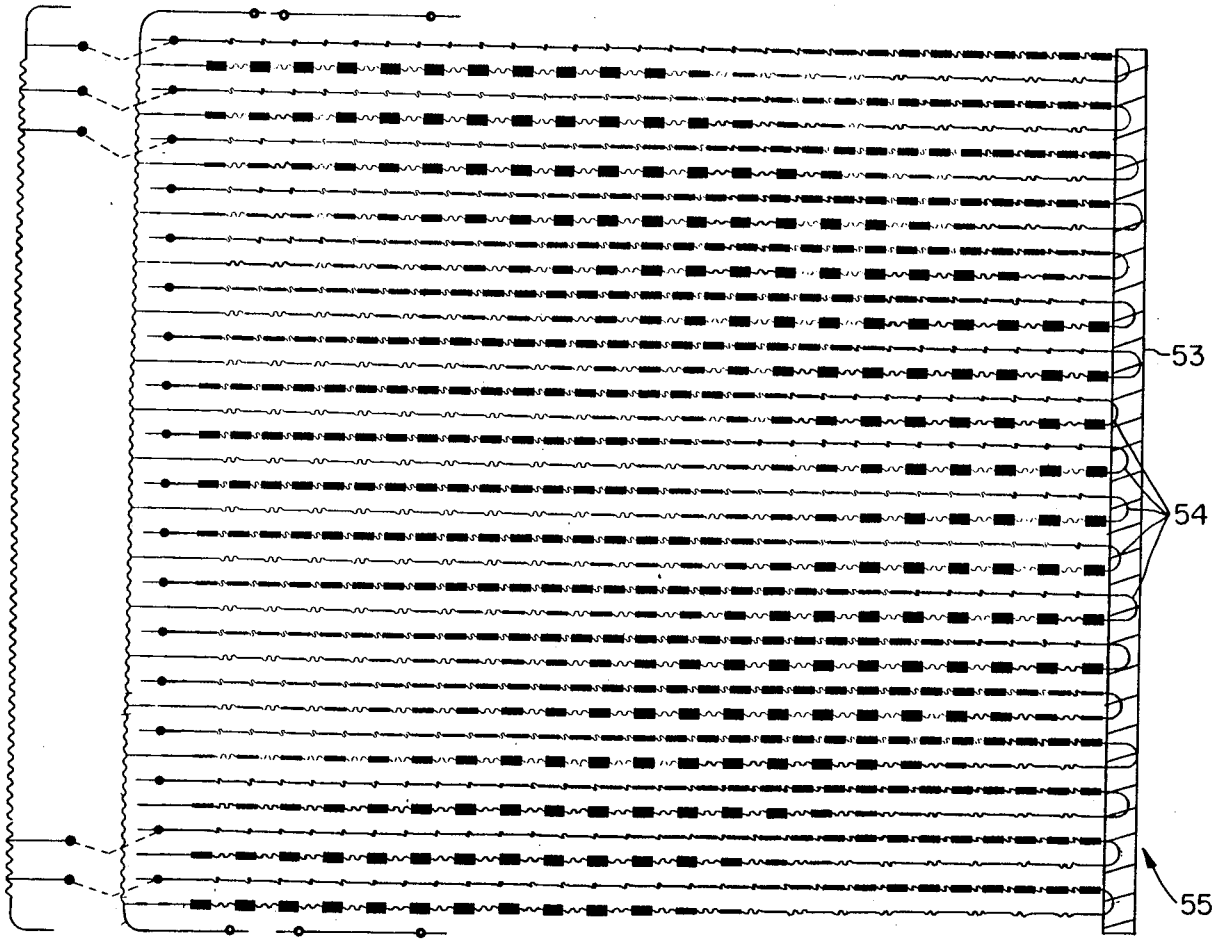
FIG. 8A illustrates the radiating plane of the present invention.
Figure 8C:
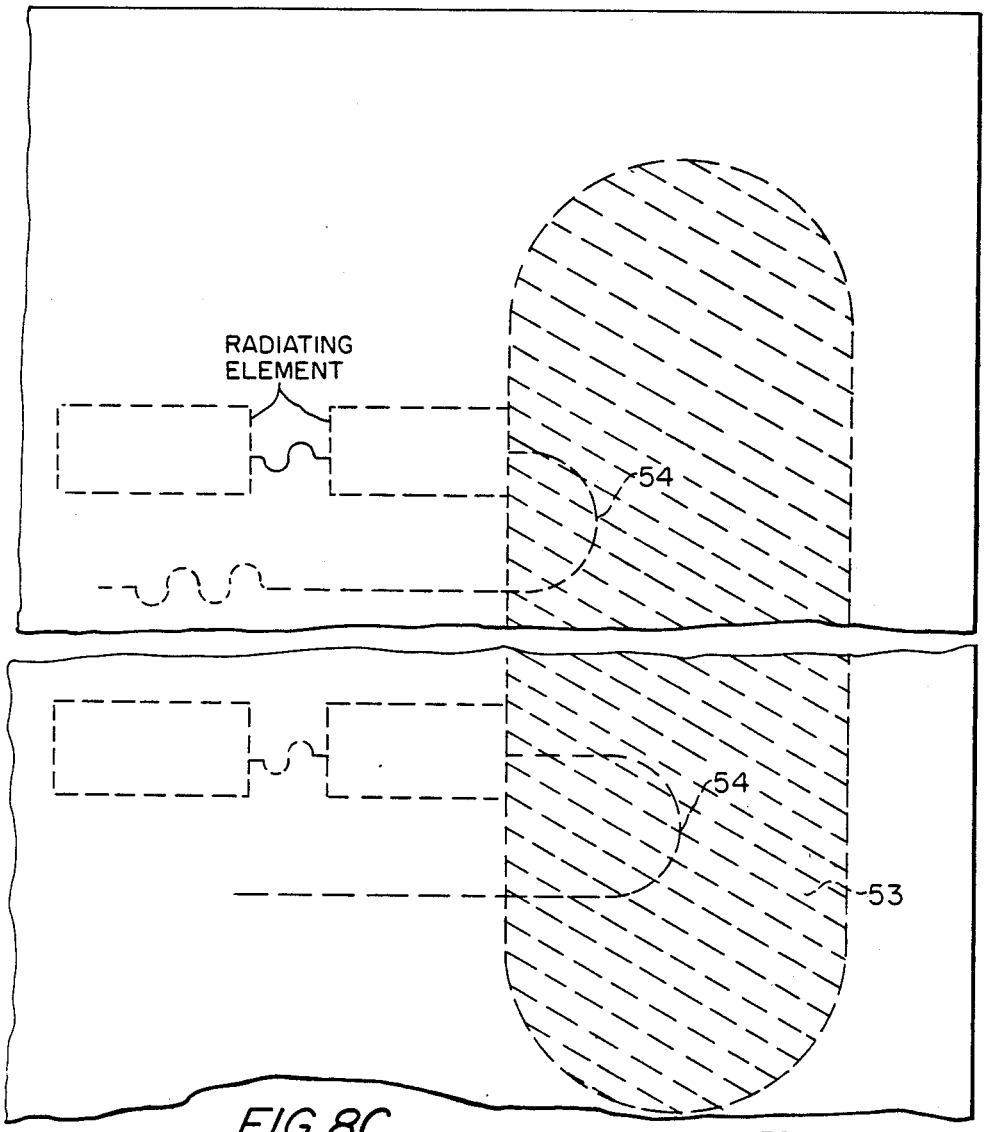
FIG. 8C is a plan view of a portion of the apertures encased at the loop ends by the bulk load.
Figure 8B:
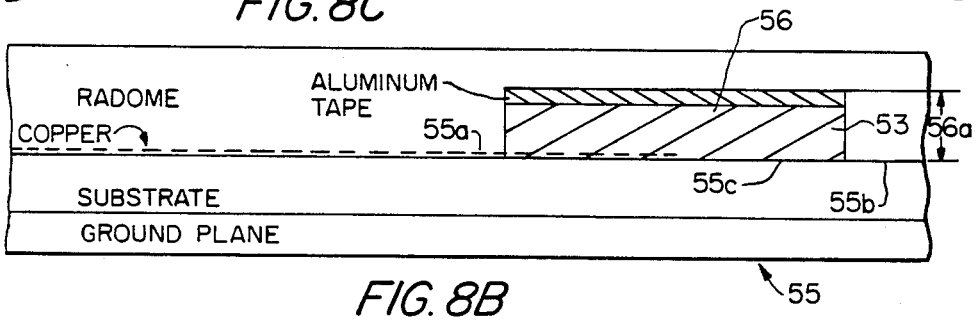
FIG. 8B is an enlarged semi cross-sectional view of a portion of the randome and the bulk load shown in FIG. 8A.

Instead of individually loading each of the arrays, the present invention proposes to add a continuous strip of absorptive material 53, i.e. a bulk load, to absorb the excess power present at 51*a*. Referring to FIGS. 8A and 8B, the present invention uses a continuous strip of absorbing material 53 for simultaneously overlapping a section 55 of the microstrip antenna at the end of each array contacting and covering entirely loops 54. By putting the continuous strip of material 53 at the end of each array, the level of power for the images is found to be reduced to approximately 20.5 db, thereby giving a 4 dB margin of safety.

The bulk loading of the microstrip antenna of the present invention is as follows. Referring to FIG. 8B, a slot 56, of depth 56*a*, is cut in the teflon-fiberglass radome, and a strip of absorber material 53 is placed therein. This absorber material is made by the Emerson and Cumings Company. For illustration purposes only, this material can be a silicon rubber-based absorber which is nominally resonant at 14 GHz when backed with an aluminum tape. The radome is then bonded to the copper/substrate surface by means of a thin bonding film at interface 55A/55B. The absorber, which is cut slightly thicker than the depth 56A, is forced into contact with the loops 54 when the radome is bonded. The bonding film has been removed at interface 55C to allow this contact to occur. All of the loops of the antenna are covered such that most of the residual power at 51A is absorbed by absorber material 53. Although not completely eliminated, the absorption of most of the residual power by the bulk load results in an acceptable reduction of the residual power. Thus, the present invention has created a load for all of the arrays of the microstrip antenna, without significantly increasing cost or labor. Also, power that otherwise would have traveled into the alternate set of arrays and which would have contributed to the enhancement of the $\sigma$ image is reduced to an acceptable level. Tests performed after the bulk load has been added show that the power of the images went down from 15 dB to 20.5 dB.

It should be understood that the invention is not limited to the exact details of construction shown and described herein for obvious modifications will occur to persons skilled in the prior art.

We claim:

1. A microstrip antenna including first and second antenna apertures for reducing image beams to an acceptable level, the antenna comprising:

a plurality of parallel first arrays, corresponding to the first antenna aperture, located in spaced coplanar relation;

a corresponding plurality of parallel second arrays, corresponding to the second antenna aperture, positioned in coplanar interleaved relation with the first arrays; each of the second arrays being connected, at a first end, to a first end of a corresponding adjacent first array;

first feed means connected to respective second ends of the first arrays for delivering power thereto;

second feed means connected to respective second ends of the second arrays for delivering power thereto; and an absorber means placed in intimate contact with the connected first ends of the first and second arrays, thereby signficantly reducing reflected residual power in the arrays.

2. The antenna structure set forth in claim 1, wherein each array comprises a plurality of linked radiator elements.

3. The antenna structure set forth in claim 1 wherein the first feed means comprises a straight printed circuit feed line positioned in coplanar transverse relation to the first arrays, the first feed means further comprising means for connecting thereto each of the first arrays.

4. The antenna structure set forth in claim 1, wherein the first feed means comprises a serpentine printed circuit feed line positioned in coplanar transverse relation to the first arrays, the first feed means further comprising means for connecting thereto each of the first arrays.

5. The antenna structure set forth in claim 1, wherein the second feed means comprises a straight printed circuit feed line positioned in transverse relation to the second arrays, the second feed means further comprising means for connecting thereto each of the second arrays.

6. The antenna structure set forth in claim 1, wherein the second feed means comprises a serpentine printed circuit feed line positioned in transverse relation to the second arrays, the second feed means further comprising means for connecting thereto each of the second arrays.

7. The antenna structure set forth in claim 1, wherein the connected ends of each set of corresponding first and second arrays are shaped into a loop configuration.

8. The antenna structure set forth in claim 7, wherein the absorber means comprises a continuous strip of absorber material.

9. The antenna structure set forth in claim 8, wherein the strip of absorber material is normally resonant at a frequency of approximately 14 GHz when backed with a metallic means.

10. The antenna structure set forth in claim 8, wherein the strip of absorber material comprises silicon rubber.

11. The antenna structure set forth in claim 8, wherein the strip of absorber material is in intimate contact with the looped ends.

12. A printed circuit microstrip antenna, comprising:

a plurality of parallel forward-firing arrays, corresponding to a first antenna aperture, located in spaced coplanar relation;

a corresponding plurality of parallel backward firing arrays, corresponding to a second antanna aperture, positioned in coplanar interleaved relation with the forward-firing arrays; a first end of each of the backward-firing arrays being connected with a first end of a corresponding adjacent forward-firing array for forming a loop configuration at the first ends thereof;

first feed means connected to respective second ends of the forward-firing arrays for delivering power thereto;

second feed means connected to respective second ends of the second arrays for delivering power thereto; and a strip of absorber material placed in intimate contact with the loop configurations of the arrays for substantially reducing reflected residual power in the arrays.

13. A microstrip antenna including first and second antenna apertures for reducing image beams to an acceptable level, the antenna comprising:

a plurality of parallel first arrays, corresponding to the first antenna aperture, located in spaced coplanar relation;

a corresponding plurality of parallel second arrays, corresponding to the second antenna aperture, positioned in coplanar interleaved relation with the first arrays; each of the second arrays being connected, at a first end, to a first end of a corresponding adjacent first array for forming respective loop configurations;

first feed means positioned in coplanar transverse relation to the first arrays and connected to respective second ends of the first arrays for delivering power thereto; and second feed means positioned in transverse relation to the second arrays and connected to respective second ends of the second arrays for delivering power thereto; and an absorber means placed in intimate contact with the connected first ends of the first and second arrays, the absorber means being a continuous strip of silicon rubber material, backed with a metallic material, having a nominal resonant frequency of approximately 14 GHz, for significantly reducing reflected residual power in the arrays.

14. In a microstrip antenna including a plurality of parallel forward-firing arrays located in interleaved spaced coplanar relationship with a plurality of parallel backward-firing arrays wherein each of the backward-firing arrays is connected at a first end thereof with a first end of a corresponding adjacent forward-firing array for forming a loop configuration at the first ends thereof, the forward-firing arrays and the backward-firing arrays being powered by a first and a second feed means, respectively, a method of reducing reflected residual power in the arrays, comprising the steps of:

locating the loop configuration at the first ends of the arrays; and placing a continuous strip of absorber material in intimate contact with the loop configuration at the first ends of the arrays for substantially reducing reflected residual power in the arrays.

* * * * *